US005642817A

United States Patent [19]

O'Brien

[11] Patent Number: 5,642,817

[45] Date of Patent: Jul. 1, 1997

[54] HANGING DEVICE FOR BELTS

[76] Inventor: Sonja F. O'Brien, 5880 Lakeview Dr., Greendale, Wis. 53129

[21] Appl. No.: 622,993

[22] Filed: Mar. 28, 1996

[51] Int. Cl.[6] ..... A47F 1/04; A47F 7/00

[52] U.S. Cl. ..... 211/60.1; 223/88

[58] Field of Search ..... 211/60.1, 59.1, 211/87, 113, 119; 248/215; 223/88, 91, DIG. 1, DIG. 2, DIG. 3; D6/315, 317, 320, 322

[56] References Cited

U.S. PATENT DOCUMENTS

| | | | |
|---|---|---|---|
| 381,888 | 4/1888 | Rice | 223/88 |
| 749,455 | 1/1904 | Shoeneman | 223/88 |
| 845,443 | 2/1907 | Allardice | 223/88 X |
| 1,248,760 | 12/1917 | Wallin . | |
| 1,332,533 | 3/1920 | Wordingham | 223/88 |
| 2,058,416 | 10/1936 | Comstock | 223/88 X |
| 2,153,551 | 4/1939 | Diener | 223/88 |
| 2,187,579 | 1/1940 | Von Knopke | 223/91 |
| 2,374,329 | 4/1945 | Coney | 223/88 |
| 2,374,330 | 4/1945 | Coney | 223/88 |
| 2,476,051 | 7/1949 | Lev | 223/94 |
| 2,499,188 | 2/1950 | Freeman | 211/119 |
| 2,529,296 | 11/1950 | Kay | 223/88 |
| 2,550,167 | 4/1951 | Simmons | 223/88 |
| 2,575,979 | 11/1951 | Simon et al. | 223/91 X |
| 2,646,195 | 7/1953 | Kleist | 223/88 |
| 2,940,647 | 6/1960 | Clement | 223/85 |
| 3,017,059 | 1/1962 | Dzienisiewicz | 223/91 |
| 3,018,026 | 1/1962 | Binkley et al. | 223/91 |
| 3,194,457 | 7/1965 | Freilich | 223/88 |
| 3,419,239 | 12/1968 | Ginther | 248/215 |
| 3,463,324 | 8/1969 | Schaefer | 211/123 |
| 3,613,896 | 10/1971 | Miller, Jr. | 211/107 |
| 3,710,996 | 1/1973 | Smilow et al. | 223/87 |
| 3,887,079 | 6/1975 | Crew | 211/118 |
| 3,993,205 | 11/1976 | Pilchard | 211/116 |
| 4,063,669 | 12/1977 | Smilow et al. | 223/87 |
| 4,136,784 | 1/1979 | Knobel et al. | 211/119 |
| 4,474,316 | 10/1984 | Philibert | 223/88 |
| 4,632,285 | 12/1986 | Dillingham | 223/DIG. 1 X |
| 4,714,156 | 12/1987 | Kolton et al. | 206/296 |
| 4,718,546 | 1/1988 | Kolton et al. | 206/296 |
| 4,778,088 | 10/1988 | Miller | 223/91 |
| 4,872,568 | 10/1989 | Lehmann | 211/113 |
| 4,930,692 | 6/1990 | Smilow et al. | 223/85 |
| 5,022,538 | 6/1991 | Richmond et al. | 211/113 |
| 5,193,676 | 3/1993 | Gold | 206/296 |
| 5,222,638 | 6/1993 | Kolton et al. | 223/87 |
| 5,240,120 | 8/1993 | McDonough | 211/13 |
| 5,289,956 | 3/1994 | Petrou | 223/88 X |
| 5,303,855 | 4/1994 | Veale | 223/88 X |

*Primary Examiner*—Alvin C. Chin-Shue
*Assistant Examiner*—Sandra Snapp
*Attorney, Agent, or Firm*—Andrus, Sceales, Starke & Sawall

[57] ABSTRACT

A hanging device is provided for supporting a plurality of belts having a belt buckle and an opening therethrough. The hanging device includes a hanger which defines a closed loop, and one or more ring members hanging therefrom. Each ring member includes a circular band having a break therein. The ring member is manipulatable between a first configuration wherein the circular band defines a closed loop, and a second configuration wherein the ring member is manually separatable such that a portion of the ring member may be inserted through the opening of the belt buckle so as to retain the belt buckle on the ring member.

13 Claims, 2 Drawing Sheets

FIG. 1
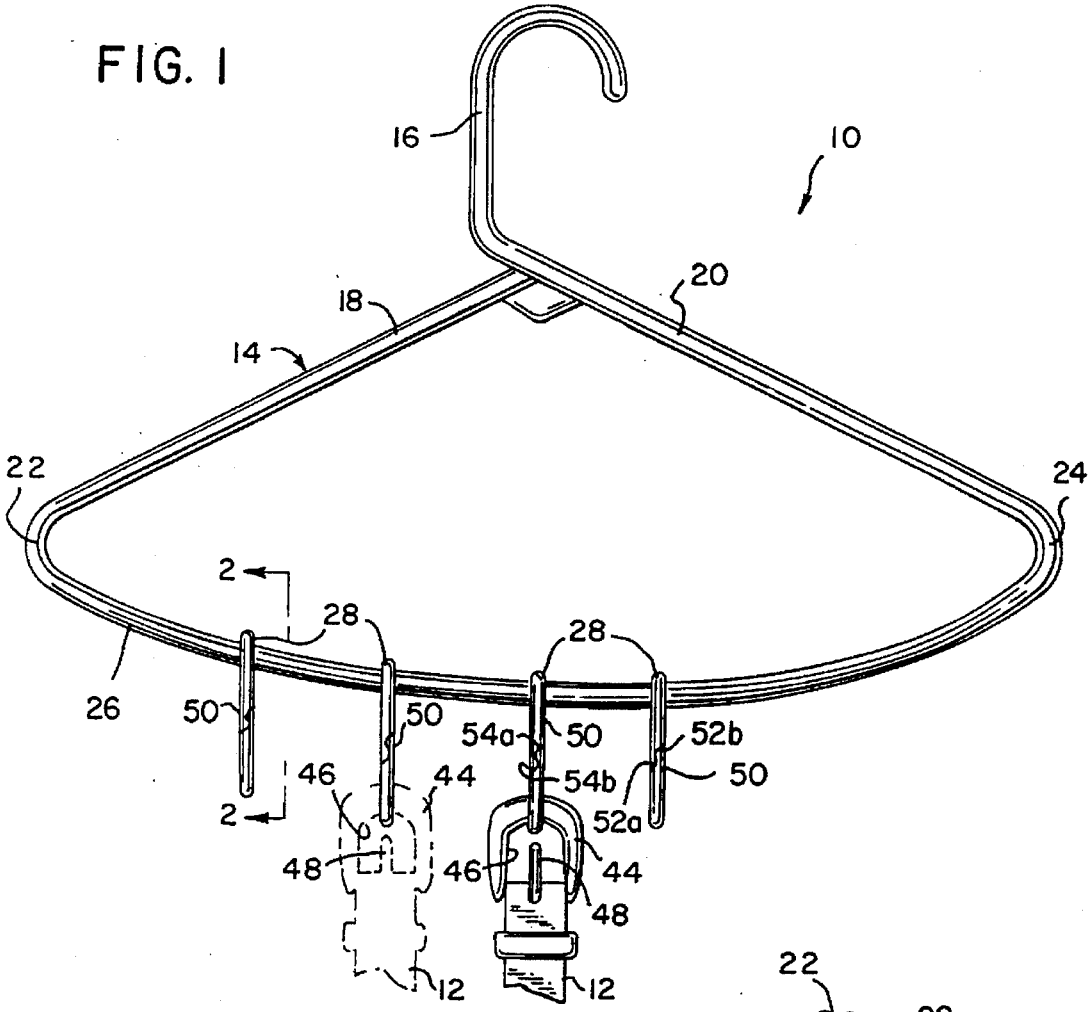
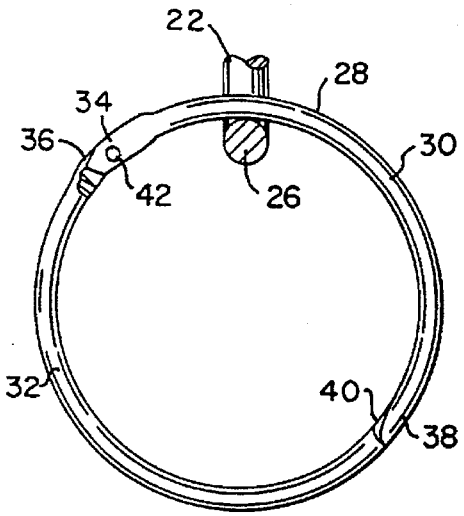
FIG. 2
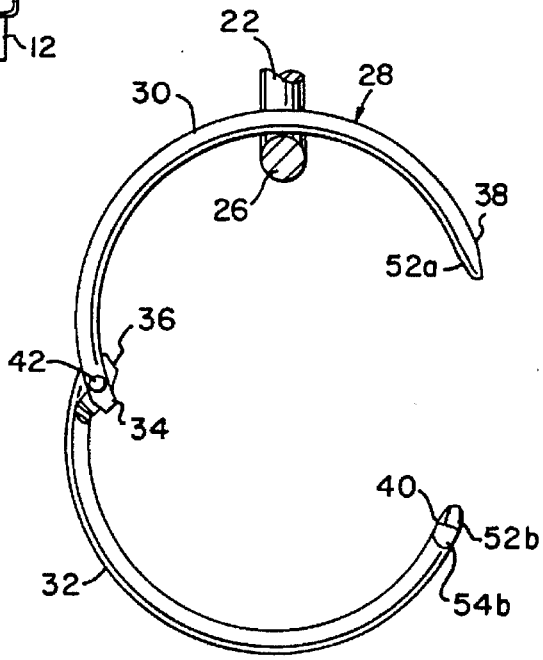
FIG. 3

FIG. 4
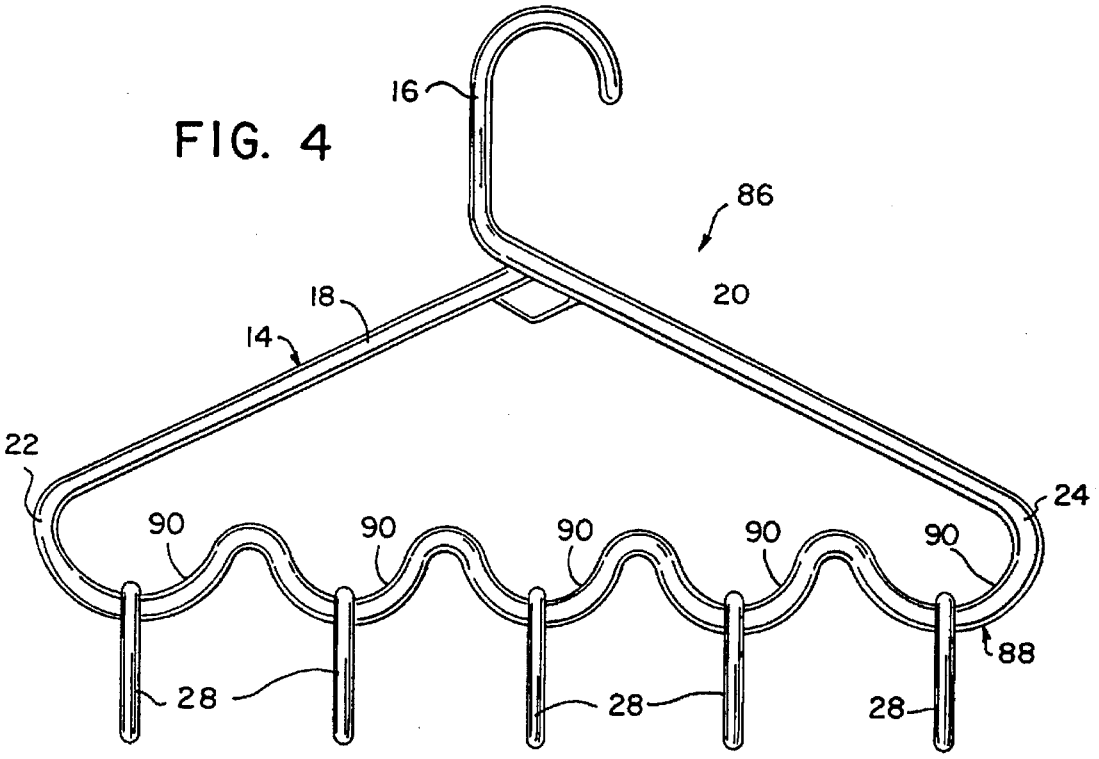
FIG. 5
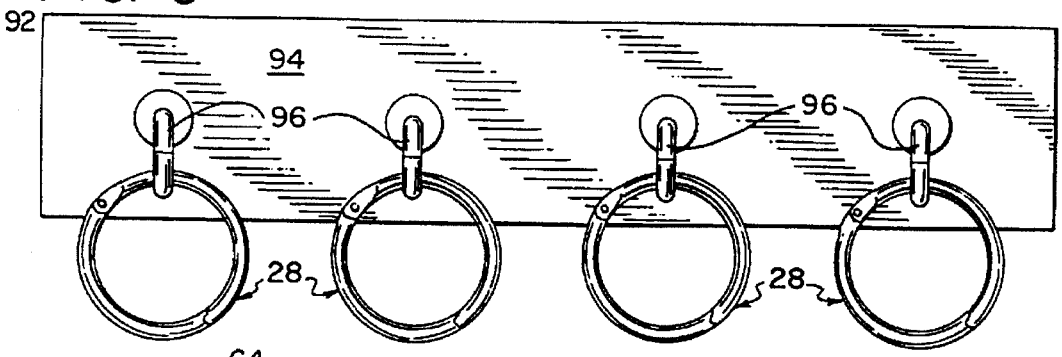
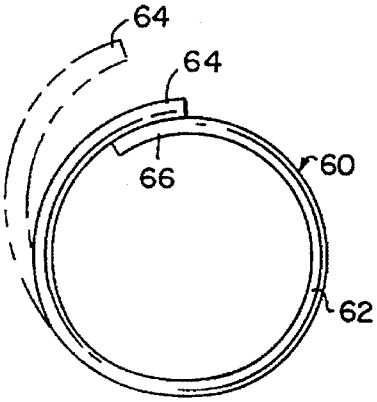
FIG. 6
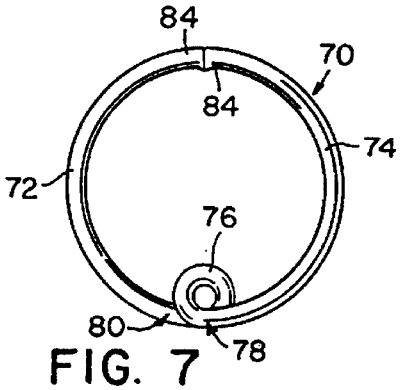
FIG. 7

HANGING DEVICE FOR BELTS

BACKGROUND AND SUMMARY OF THE INVENTION

This invention relates to hanging devices, in particular, a hanging device for hanging a plurality of belts by their respective belt buckles.

A standard fashion accessory in most wardrobes is the belt. Most belt wearers have a plurality of belts which differ in size, in color and in style in order to match the corresponding outfit worn by the belt wearers. In that belts are constructed from relatively flat elongated strips of material such as leather, the storage of a significant number of belts by the belt wearer presents unique problems.

Typically, the owner of a plurality of belts will place the belts in a drawer of a dresser or the like for storage. Depending on the number of belts, locating a particular desired belt from a large collection stored in a dresser drawer may be difficult. In addition, the storage of a plurality of belts in a dresser drawer eliminates storage space for other clothing articles such as shirts, socks, and undergarments. Further, the elongated strips of material which comprise the belts may be inadvertently tangled in the confines of the dresser drawer so as to potentially cause damage to the material upon the removal of the belts from the dresser drawer.

Previous attempts to construct a device for hanging belts have been limited. For example, in U.S. Pat. No. 4,930,692, a belt hanger is provided for displaying an individual belt on sale. The device disclosed in the '692 patent is limited in that the belt hanger only holds a single belt, and is not reusable. Hence, once the belt is removed from the hanging device disclosed in the '692 patent, the hanging device is rendered useless.

Further, belt hangers which incorporate a hook or the like to allow for a user to hang a belt by the belt buckle are limited and inconvenient. Depending on the depth of the hook, only a fixed number of belts may be supported. Further, it is highly probable that a belt buckle may be accidentally forced from the hook thereby allowing the belt to fall to the floor. Finally, if a plurality of belts are hung from a single hook, the user must remove all of the belts between the end of the hook and the desired belt in order to gain access to the desired belt. This process is not only inconvenient, but increases the time required to select the desired belt since all undesired belts must not only be removed from the hook, but rehung on the hook thereafter.

Therefore, it is the primary object of the present invention to provide a hanging device for hanging a plurality of belts by their respective belt buckles.

It is a further object and feature of the present invention to provide a hanging device for hanging a plurality of belts which allows for the belts to be vertically displayed.

It is a still further object and feature of the present invention to provide a hanging device for hanging a plurality of belts which allows the user to simply and easily select a desired belt and remove the same from the hanging device.

It is a still further object and feature of the present invention to provide a hanging device for hanging a plurality of belts which is inexpensive to manufacture.

A hanging device is provided for hanging a plurality of belts, each of which having a belt buckle with an opening therethrough. The hanging device includes a hanger having a hook portion and a body portion depending therefrom. The body portion includes first and second arms diverging from the hook portion, and a support rod interconnecting the arms such that the body portion defines a closed loop.

The hanging device of the present invention further includes one of more ring members. Each ring member is defined by first and second segments terminating in manually separable ends such that each member is manipulatable between a first configuration wherein terminating ends of each segment abut and each ring member forms a closed loop, and a second configuration wherein the terminating ends are separated so as to allow the ring member to be positioned about the support rod and to allow insertion of one of the terminating ends through the opening in the belt buckle of each belt.

In an alternate embodiment, the hanging device includes a hanging member supportable by a support. The hanging member defines a closed loop.

The hanging device of the alternate embodiment further includes a ring member having a circular band with a break therein. The ring member is manipulatable between a first configuration wherein the circular band defines a closed loop, and a second configuration wherein the portion of the frame may be inserted through the break in the ring member so as to allow the ring member to hang on the hanging member, and wherein a portion of the ring member may be inserted through the opening in the belt buckle of each belt in order to retain the belt buckle on the ring member.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is front elevational view of a hanging device in accordance with the present invention;

FIG. 2 is a cross-sectional view of the hanging device of FIG. 1 taken along line 2—2 showing a ring member in a first configuration;

FIG. 3 shows the ring member of FIG. 2 in a second configuration;

FIG. 4 is a front elevational view of a second embodiment of the hanging device of the present invention;

FIG. 5 is a front elevational view of a third embodiment of the hanging device of the present invention;

FIG. 6 is a second embodiment of the ring member of FIG. 2 showing the ring member in a first configuration, and showing in phantom the ring member in a second configuration; and FIG. 7 is a third embodiment of the ring member of FIG. 2.

DETAILED DESCRIPTION OF THE PREFERRED EMBODIMENT

Referring to FIG. 1, the hanging device of the present invention is generally designated by the reference numeral 10. Hanging device 10 is designed for supporting a plurality of belts 12 or the like therewith.

Hanging device 10 includes a hanger 14 having a hook portion 16 which is dimensioned for receipt on a standard horizontal clothes rod (not shown), as is conventional. Hanger 14 includes first 18 and second 20 diverging arms which depend from hook portion 16. Each arm 18 and 20 terminates at rounded corners 22 and 24, respectively.

Hanger 14 further includes a support rod 26 which interconnects rounded corners 22 and 24. In a first embodiment shown in FIG. 1, support rod 26 is arcuate in shape in order to direct ring members 28 away from rounded corners 22 and 24 and in order to discourage ring member 28 from sliding toward rounded corners 22 and 24 and thereby tilting hanger 14 with respect to the clothes rod.

Referring to FIG. 2, a ring member 28 is provided. Ring member 28 includes first 30 and second 32 arcuate segments. Each segment 30 and 32 includes a first end 34 and 36, respectively, and an opposite second, terminating ends 38 and 40, respectively. First end 34 of segment 30 and first end 36 of segment 32 are pivotably interconnected by a pin 42 so as to allow ring member 28 to be manipulated between first configuration, as shown in FIG. 2, wherein the terminating ends 38 and 40 of segments 30 and 32, respectively, abut, and a second configuration wherein the terminating ends 38 and 40 of segments 30 and 32, respectively, are separated, as shown in FIG. 3. In the first configuration, ring member 28 defines a closed loop.

With ring member 28 in the second configuration as shown in FIG. 3, support rod 26 may be inserted through the separation between terminating ends 38 and 40 of segments 30 and 32, respectively, into the area defined between segments 30 and 32 of ring member 28. Thereafter, ring member 28 may be returned to the first configuration, as shown in FIG. 2, thereby capturing support rod 26 therein and hence, allowing ring member 28 to hang from support rod 26 of hanger 14 as seen in FIG. 1.

As described above, the hanging device 10 of the present invention is designed for hanging a plurality of belts 12. Each belt 12 includes a buckle 44 defining an opening 46 therein. As is conventional, a tongue 48 is pivotably mounted to belt 12 and extends into opening 46.

With ring member 28 in the second configuration as shown in FIG. 3, one of the terminating ends 38 and 40 of segments 30 and 32, respectively, may be inserted through opening 46 in belt buckle 44 so as to allow belt 12 to hang on ring member 28. Ring member 28 may then be returned to the first configuration, as shown in FIG. 2, in order to capture belt buckle 42 and retain belt buckle 42 on ring member 28. It is contemplated that a plurality of belts 12 may be retained on a single ring member 28 utilizing the steps described above.

In order to remove belt buckle 44 from ring member 28, ring member 28 is manipulated from the first configuration shown in FIG. 2, to the second configuration shown in FIG. 3 so as to allow a user selected belt buckle 44 to be slid past a user selected terminating end 38 and 40 of segments 30 and 32, respectively, of ring member 28. To prevent the accidental manipulation of ring member 28 from the first configuration shown in FIG. 2 to the second configuration shown in FIG. 3, a catch 50 may be integrally formed in the terminating ends 38 and 40 of segments 30 and 32, respectively, of ring member 28.

Each terminating end 38 and 40 includes a tab portion **52*a* and 52*b*, respectively, and tab receiving grooves 54*a* and 54*b*, respectively. As best seen in FIG. 1, tab 52*a* extends from terminating end 38 of segment 30 and is receivable within tab receiving groove 54*b* formed in terminating end 40 of segment 32. Tab 52*b* extends from terminating end 40 of segment 32 and is receivable within tab receiving groove 54*a* formed in terminating end 38 of segment 30. With tabs 52*a* and 52*b* received within tab receiving groove 54*b* and 54*a*, respectively, ring member 28 is maintained in the first configuration shown in FIG. 2**.

Referring to FIG. 6, an alternate ring member 60 is disclosed. Ring member 60 includes wire member 62 which forms a closed loop. Wire member 62 is constructed of a resilient material and includes first 64 and second 66 overlapping ends which are biased toward each other such that the ring member 60 assumes a first configuration as shown in FIG. 6. Ends 64 and 66 of wire member 62 may be separated, as shown in phantom in FIG. 6, so as to allow support rod 26 to be inserted through the separation therebetween such that support rod 26 may be captured within ring member 60, for reasons described above. Similarly, ends 64 and 66 may be separated so as to allow one of the ends 64 or 66 to be inserted through opening 46 in belt buckle 44 so as to allow belt 12 to hang on ring member 60 in the manner shown in FIG. 1.

Referring to FIG. 7, a still further alternate embodiment for ring member 70 is shown. Ring member 70 includes a wire member having first 72 and second 74 segments interconnected by a coil spring 76 integral with a first end 78 of segment 74 and a first end 80 of segment 72. Segments 72 and 74 include second, opposite terminating ends 82 and 84, respectively, which are biased 72 and 74 toward each other by coil spring 76 such that ring member 70 assumes a first configuration wherein the terminating ends 82 and 84 abut.

Terminating ends 82 and 84 of segments 72 and 74, respectively, may be manually separated by a user in order to allow support rod 26 to be inserted through the separation between terminating ends 82 and 84. By releasing segments 72 and 74, coil spring 76 returns ring member 70 to its original first configuration thereby capturing support rod 26 therein, and hence, allowing ring member 70 to hang from support rod 26 in the manner shown in FIG. 1.

Similarly, terminating ends 82 and 84 may be manually separated in order that one of the terminating ends 82 and 84 of segments 72 and 74, respectively, may be inserted through opening 46 in belt buckle 44 so as to allow belt 12 to hang on rim member 70, as described above.

Referring to FIG. 4, an alternate hanging device 86 is shown. Hanging device 86 has the same operational purpose as hanging device 10, and as such, where the components are identical, common reference characters have been used to facilitate understanding.

Hanging device 86 includes a hanger 14 having a hook portion 16 which is dimensioned for receipt on a standard horizontal clothes rod, as is conventional. Hanger 14 further includes first 18 and second 20 diverging arms which depend from hook portion 16. Each arm 18 and 20 terminates at rounded corners 22 and 24, respectively. Hanger 14 further includes a support rod 88 which interconnects rounded corners 22 and 24. In the second embodiment shown in FIG. 6, support rod 88 includes a plurality of spaced, ring member supporting depressions 90 therein giving supporting rod 88 a generally sinusoidal shape. Depressions 90 allow the user to separate ring members 28, thereby facilitating access to individual ring members 28 hanging on support rod 88.

Referring to FIG. 5, a still further embodiment of the hanging device of the present invention is generally designated by the reference numeral 92. Hanging device 92 includes a support 94 which may be mounted vertically or horizontally on the interior wall of a closet or the like. Support 94 includes a plurality of spaced, rings 96 mounted thereon. Each ring 96 is adapted for supporting one or more ring members 28.

As described above, terminating ends 38 and 40 may be manually separated so as to allow one of the terminating ends 38 and 40 to be inserted through the opening defined by ring 96 so as to capture ring 96 and allow ring member 28 to hang therefrom.

It is contemplated that the alternate embodiments of hanging devices 86 and 92 shown in FIGS. 4 and 5, respectively, may be also used in conjunction alternate ring members 60 and 70 shown in FIGS. 6 and 7, respectively.

Various modes of carrying out the invention are contemplated as being within the scope of the following claims particularly pointing out and distinctly claiming the subject matter which is regarded as the invention.

I claim:

1. A hanging device for supporting a plurality of belts, comprising:

a hanger having a hook portion and a body portion depending therefrom, the body portion including first and second arms diverging from the hook portion, and a support rod interconnecting the arms such that the body portion defines a closed loop;

a ring member, the ring member defined by first and second segments, each segment terminating at a first manually separable end such that the ring member is manipulatable between a first configuration wherein the first ends of each segment abut and the ring member forms a closed loop, and a second configuration wherein the first ends are separated so as to allow the ring member to be positioned about the support rod, each segment further terminating at a second end; and a pin extending through and interconnecting the second ends of each segments such that each segment pivots about the pin as the ring member is manipulated between its first and second configuration.

2. The hanging device of claim 1 wherein the first and second segments are pivotably interconnected.

3. The hanging device of claim 1 further comprising a means for biasing the terminating ends of each segment toward each other.

4. The hanging device of claim 1 further comprising a means for retaining each ring member in the first configuration.

5. The hanging device of claim 1 wherein the support rod of the hanger is arcuate in shape.

6. The hanging device of claim 1 wherein the support rod includes a plurality of spaced, ring member supporting depressions therein.

7. The hanging device of claim 1 wherein the support rod is generally sinusoidal in shape.

8. The hanging device for hanging belts, comprising:

a hanging member supportable by a support, the hanging member defining a closed loop;

a rig member including a circular band having a break therein, the ring member manipulatable between a first configuration wherein the circular band defines a closed loop, and a second configuration wherein a portion of the hanging member may be inserted through the break in the ring member so as to allow the ring member to hang thereon, the circular band including first and second segments, each segment terminating at a first manually separatable end, each manually separatable end abutting the other end when the ring member is in the first configuration; and means for biasing the manually separatable ends of each segment toward each other.

9. The hanging device of claim 8 wherein the hanging member further includes a hook portion.

10. The hanging device of claim 9 wherein the closed loop of the hanging member depends from the hook portion, the closed loop including first and second arms diverging from the hook portion, and a support rod interconnecting the arms.

11. The hanging device of claim 8 wherein the first and second segments are pivotably interconnected.

12. The hanging device of claim 8 wherein the first and second segments are integrally molded.

13. The hanging device of claim 8 further comprising a means for retaining the ring member in the first configuration.

* * * * *